US011840765B2

(12) United States Patent
Rigo et al.

(10) Patent No.: US 11,840,765 B2
(45) Date of Patent: Dec. 12, 2023

(54) NITRIDING PROCESS FOR CARBURIZING FERRIUM STEELS

(71) Applicant: GE Avio S.r.l., Turin (IT)

(72) Inventors: Lorenzo Rigo, Monta d'Alba (IT); Andrea Piazza, Turin (IT); Diana Di Gioia, Andria (IT)

(73) Assignee: GE Avio S.r.l., Turin (IT)

( * ) Notice: Subject to any disclaimer, the term of this patent is extended or adjusted under 35 U.S.C. 154(b) by 24 days.

(21) Appl. No.: 17/509,362

(22) Filed: Oct. 25, 2021

(65) Prior Publication Data

US 2022/0042158 A1 Feb. 10, 2022

Related U.S. Application Data

(63) Continuation of application No. 16/210,078, filed on Dec. 5, 2018, now Pat. No. 11,162,167.

(30) Foreign Application Priority Data

Dec. 22, 2017 (EP) ..... 17425130

(51) Int. Cl.

| | |
|---|---|
| ***C23C 8/38*** | (2006.01) |
| ***C21D 1/06*** | (2006.01) |
| ***C23C 8/34*** | (2006.01) |
| ***C21D 9/32*** | (2006.01) |
| ***C23C 8/02*** | (2006.01) |
| *C22C 38/44* | (2006.01) |
| *C22C 38/52* | (2006.01) |

(52) U.S. Cl.

CPC ..... *C23C 8/38* (2013.01); *C21D 1/06* (2013.01); *C21D 9/32* (2013.01); *C23C 8/02* (2013.01); *C23C 8/34* (2013.01); *C22C 38/44* (2013.01); *C22C 38/52* (2013.01)

(58) Field of Classification Search

CPC ..... C23C 8/38; C23C 8/02; C22C 38/52

See application file for complete search history.

(56) References Cited

U.S. PATENT DOCUMENTS

| | | | | |
|---|---|---|---|---|
| 2,946,708 | A | 7/1960 | Berghaus | |
| 5,363,400 | A | 11/1994 | Damond et al. | |
| 5,393,488 | A * | 2/1995 | Rhoads | C22C 38/52 420/95 |
| 6,176,946 | B1 | 1/2001 | Kuehmann et al. | |
| 7,204,952 | B1 | 4/2007 | Poor et al. | |
| 8,808,471 | B2 | 8/2014 | Wright et al. | |
| 2006/0048858 | A1 | 3/2006 | Cooper et al. | |
| 2008/0120843 | A1 | 5/2008 | Thompson et al. | |
| 2009/0223502 | A1 | 9/2009 | Chaudhry et al. | |
| 2010/0025500 | A1 | 2/2010 | Pollard et al. | |
| 2011/0277886 | A1 | 11/2011 | Xie et al. | |
| 2012/0118434 | A1 | 5/2012 | Konishi et al. | |
| 2016/0305007 | A1 | 10/2016 | Hiramatsu et al. | |

FOREIGN PATENT DOCUMENTS

| | | | |
|---|---|---|---|
| CN | 105087886 | A | 11/2015 |
| EP | 2460906 | A1 | 7/2009 |
| EP | 2098757 | A2 | 9/2009 |
| WO | WO2008/0127439 | A2 | 10/2008 |
| WO | WO2016/003522 | A2 | 1/2016 |

OTHER PUBLICATIONS

CarTech Ferrium C61, Questek, Carpenter Technology Corp, 2015, p. G1271-20.

CarTech Ferrium C64, Questek, Carpenter Technology Corp, 2015, p. G1281-20.

Dai Dahuang et al., "Modern Material Surface Technology Science", Metallurgical Industry Press, 1st Edition, 2004, pp. 195-199 (No translation found).

Kleff et al., New Approaches to the Heat Treatment and Surface Treatment of Heavily Loaded Aerospace Transmission Components, XP-00893946, New Heat Treatment and Surface Treatment Methods, vol. 55, No. 2, Jan. 1, 2000.

QuesTek Innovations LLC, FERRIUM C61 Technical Data Sheet, FERRIUM C-61 Case-Hardened Gear Steel with Ultrahigh-Strength Core, Apr. 2012, 2 Pages. http://www.questek.com/filebase/src/Material_Data_Sheets/FerriumC61.pdf.

Wright et al., Design, Development and Application of New, High-Performance Gear Steels, GEARTECHNOLOGY, vol. Jan./Feb. 2010, Jan. 1, 2010.

* cited by examiner

*Primary Examiner* — Jessee R Roe

(74) *Attorney, Agent, or Firm* — Dority & Manning, P.A.

(57) ABSTRACT

Methods for treating steel, along with the resulting treated steel, are provided. The method may comprise: nitriding a carburized Ferrium steel component such that the Ferrium steel component has a surface portion with a nitrogen content that is greater than 0% to about 5% by weight. Nitriding the Ferrium steel component may increase the surface hardness of the Ferrium steel. The surface portion may have a nitrogen content of about 0.05% to about 0.5% by weight.

12 Claims, 1 Drawing Sheet

NITRIDING PROCESS FOR CARBURIZING FERRIUM STEELS

CROSS REFERENCE TO RELATED APPLICATIONS

This application is a divisional of U.S. application Ser. No. 16/210,078, now U.S. Pat. No. 11,162,167, filed on Dec. 5, 2018, titled "NITRIDING PROCESS OF CARBURIZING FERRIUM STEELS", which is herein incorporated by reference in its entirety.

FUNDING INFORMATION

The work leading to this invention has received funding from the European Community's Seventh Framework Programme (FP7/2007-2013) for the Clean Sky Joint Technology Initiative under grant agreement no CSJU-GAM-SAGE-2008-001 and further amendments.

FIELD

This disclosure generally relates to methods for treating metals, more specifically, to methods for treating metals to improve durability in harsh environments.

BACKGROUND

Carburized steel gears are widely used for power transmission in rotorcraft, transportation vehicles, agricultural and off-road equipment, industrial rotating equipment, and thousands of other applications. Historically, alloys requiring carburization were put through an atmosphere (gas) process. However, in recent years, the advancement of low-pressure (i.e., vacuum) carburizing has led to certain applications to take advantage of reduction in process steps and improvements in case profile uniformity. A new class of gear steels, Ferrium® C61 and C64, were specifically designed and developed to maximize the benefit of vacuum carburization processes.

However, components of a gearbox system that transfers power from the fan to the low pressure turbine require improved high strength materials, in particular bearings and their integration with the surrounding components. As such, a need exists for the development of new high performed steels with efficient heat treatment.

BRIEF DESCRIPTION

Aspects and advantages will be set forth in part in the following description, or may be obvious from the description, or may be learned through practice of the invention.

Methods are generally provided for treating steel, along with the resulting treated steel. In one embodiment, the method comprising: nitriding a carburized Ferrium steel component such that the Ferrium steel component has a surface portion with a nitrogen content that is greater than 0% to 5% by weight. Generally, nitriding the Ferrium steel component increases the surface hardness of the Ferrium steel. For example, the surface portion may have a nitrogen content of 0.05% to 0.5% by weight.

In one embodiment, nitriding the Ferrium steel component may be performed via plasma nitriding the Ferrium steel component in a treatment atmosphere (e.g., 0.5 mbar to 10 mbar) comprising a nitrogen-containing gas. The treatment atmosphere comprises, in one embodiment, the nitrogen-containing gas and a carrier gas. For instance, the treatment atmosphere comprises 1% to 50% by volume of the nitrogen-containing gas (e.g., about 5% to about 25% by volume).

In particular embodiment, the carburized Ferrium steel component may be tempered prior to nitriding, such as at a tempering temperature of about 400° C. to about 550° C. For instance, tempering the carburized Ferrium steel component at a tempering temperature of about 400° C. to about 550° C. may be performed via a double tempering process that includes: performing a first tempering process on the carburized Ferrium steel component at a first tempering temperature, and thereafter, performing a second tempering process on the carburized Ferrium steel component at a second tempering temperature that is higher than the first tempering temperature.

A treated Ferrium steel component is also generally provided that includes a core of a carburized Ferrium steel component and a surface portion of the component. The core may have a composition that includes, by weight, about 0.10% to about 0.2% of carbon, about 7.0% to about 10.0% of nickel, about 16.0% to about 18.5% of cobalt, about 1.0% to about 2.0% of molybdenum, about 3.0% to about 4.0% of chromium, up to about 0.05% of tungsten, and the balance iron. The surface portion may have a composition that includes, by weight, about 0.10% to about 0.2% of carbon, about 7.0% to about 10.0% of nickel, about 16.0% to about 18.5% of cobalt, about 1.0% to about 2.0% of molybdenum, about 3.0% to about 4.0% of chromium, up to about 0.05% of tungsten, about 0.05% to about 5% of nitrogen, and the balance iron.

In one embodiment of the treated Ferrium steel component, the surface portion defines an outer surface having a surface hardness on the Rockwell scale of about 65 to about 69. For example, the surface portion may have a depth from an outer surface of the component that is up to about 35 μm.

In one particular embodiment of the treated Ferrium steel component, the core may have a composition that consists essentially of, by weight, about 0.15% carbon, about 9.5% nickel, about 18.0% cobalt, about 1.1% molybdenum, about 3.5% chromium, and the balance iron, with the carburized Ferrium steel component having a surface hardness on the Rockwell scale of about 65 to about 67.

In one particular embodiment of the treated Ferrium steel component, the core may have a composition that consists essentially of, by weight, about 0.11% carbon, about 7.5% nickel, about 16.3% cobalt, about 1.75% molybdenum, about 3.5% chromium, about 0.02% tungsten, and the balance iron, with the carburized Ferrium steel component having a surface hardness on the Rockwell scale of about 65 to about 69.

These and other features, aspects and advantages will become better understood with reference to the following description and appended claims. The accompanying drawings, which are incorporated in and constitute a part of this specification, illustrate embodiments of the invention and, together with the description, serve to explain certain principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
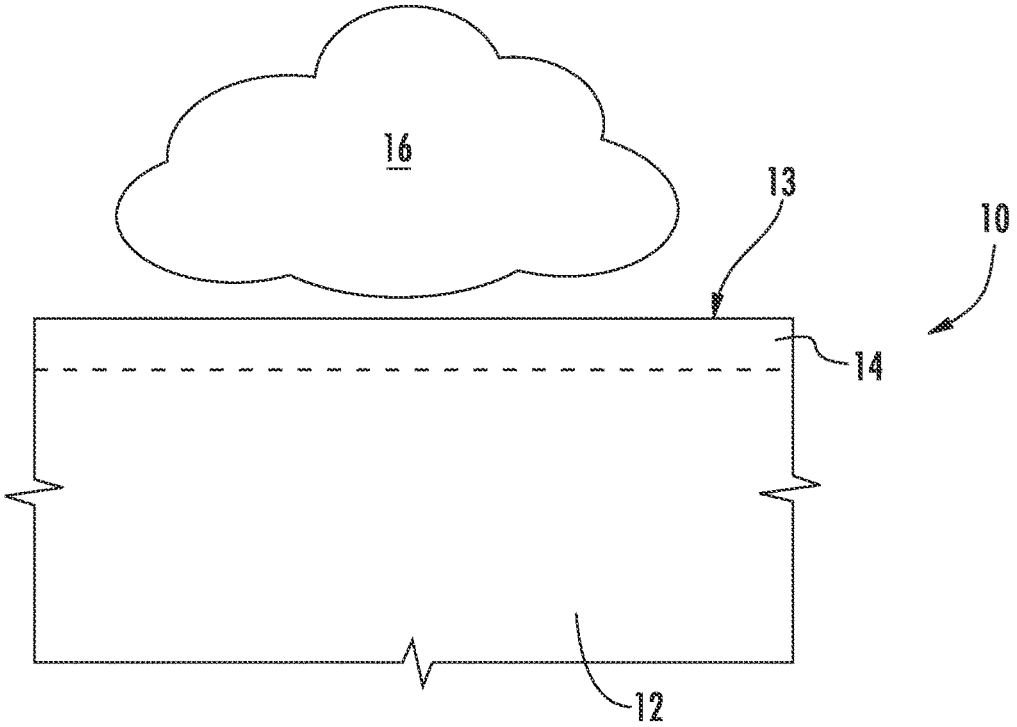
FIG. 1 shows an exemplary treated Ferrium steel component having a surface plasma nitride treated.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The compositional ranges disclosed herein are inclusive and combinable (e.g., ranges of "up to about 25 wt. %", or, more specifically, "about 5 wt. % to about 20 wt. %", are inclusive of the endpoints and all intermediate values of the ranges). Weight levels are provided on the basis of the weight of the entire composition, unless otherwise specified; and ratios are also provided on a weight basis. Moreover, the term "combination" is inclusive of blends, mixtures, alloys, reaction products, and the like. Furthermore, the terms "first," "second," and the like, herein do not denote any order, quantity, or importance, but rather are used to distinguish one element from another. The terms "a" and "an" herein do not denote a limitation of quantity, but rather denote the presence of at least one of the referenced items. The modifier "about" used in connection with a quantity is inclusive of the stated value, and has the meaning dictated by context, (e.g., includes the degree of error associated with measurement of the particular quantity). The suffix "(s)" as used herein is intended to include both the singular and the plural of the term that it modifies, thereby including one or more of that term (e.g., "the refractory element(s)" may include one or more refractory elements). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described inventive features may be combined in any suitable manner in the various embodiments.

Ferrium steels are generally provided, along with methods for hardening the surface of components formed therefrom. According to particular embodiments, the Ferrium steels may be subjected to both carburizing and nitriding. Without wishing to be bound by any particular theory, it is believed that the carburizing process leads to the high core hardness of the resulting Ferrium steel component, while the nitriding process leads to a very high surface hardness of the Ferrium steel component. As such, the treated Ferrium steel alloys may maintain the high effective case depth obtained after carburizing process to have very high core hardness and mechanical properties, while increasing its surface fatigue resistance. In addition, the thermal stability may be increased at high temperature (e.g., in an oil off condition of a gearbox component).

I. Carburizing and Tempering Process

Ferrium steels may be carburized, such as via a low pressure carburization followed by quenching (e.g., direct high pressure gas quenching). For example, in one embodiment, the Ferrium steel may be carburized via a low pressure carburization (LPC) process, which may be carried out in a vacuum furnace using hydrocarbon gases (e.g., methane, propane, ethylene, acetylene, etc., or mixtures thereof) at very low pressure and elevated carburization temperatures. In certain embodiments, the carburization temperatures may be about 850° C. to about 1100° C. (e.g., about 900° C. to about 1050° C., such as about 930° C. to about 1025° C.). The carburization pressures may be, for example, about 0.1 mbar to about 1 mbar (e.g., about 0.25 mbar to about 0.75 mbar).

In certain embodiments, the LPC process may be performed at the carburization temperatures (e.g., about 850° C. to about 1100° C.), and it may be characterized by alternate cycles of boost and diffusion of carbon for a total time (e.g., about 250 minutes to about 400 minutes, such as about 300 minutes to about 350 minutes). After carburizing, the components may be quenched directly from the carburizing temperature. For example, the carburization process may be ended by quenching, such as a nitrogen ($N_2$) quench (e.g., at a nitrogen pressure of about 760 torr to about 7500 torr, such as about 2250 torr to about 5250 torr).

After carburization and quenching, the component may be subjected to subzero treatment so as to obtain the full transformation of austenaite in martensite and to avoid the presence of retained austenite. For example, the Ferrium steel may be subjected to a sub-zero treatment (e.g., at a temperature of about 0° C. to about 100° C., such as about −50° C. to about −100° C.).

The quenched, carburized Ferrium steel, being placed in or very near its hardest possible state, may then be tempered to incrementally decrease the hardness to a point more suitable for the desired application. As such, the carburized Ferrium steel may be tempered following carburization, and prior to nitriding, in order to tailor the surface properties of the resulting treated Ferrium steel. Generally, tempering is a heat treatment technique to achieve greater toughness by decreasing the hardness of the alloy. The reduction in hardness is usually accompanied by an increase in ductility, thereby decreasing the brittleness of the metal.

Tempering generally involves heating the carburized Ferrium steel to the tempering temperature (e.g., about 400° C. to about 550° C.). For example, the carburized Ferrium steel may be double tempered through two tempering processes. In one embodiment, the first temperature process may be performed to obtain the massive carbide precipitation and conversion of retained austenite, and the second temperature process may be performed for refining and stabilizing the secondary carbides structures. For example, the first tempering process may involve heating to a first temperature (e.g., about 425° C. to about 460° C.), and the second tempering process may involve heating to a second temperature that is higher than the first temperature (e.g., about 460° C. to about 500° C.). The heating process of the first and second tempering processes may be the same or different, such as about 5° C./min to about 25° C./min (e.g., about 5° C./min to about 15° C./min). Similarly, the duration of the first and second tempering processes may be the same or different, such as from about 5 hours to about 10 hours (e.g., about 7 hours to about 9 hours).

II. Nitriding Process

Generally, the nitriding process may be performed after the steel component has been subjected to carburizing. The nitriding process may diffuse nitrogen in to the surface of the metal component to create a case-hardened surface. Through plasma nitriding, the microstructure of the surface of the steel component may be modified so as to include nitrogen therein. In certain embodiments following the nitriding treatment, the maximum nitrogen content in surface of the component may be about 0.5% by weight (e.g., greater than 0% to about 5% by weight, such as about 0.05% to about 0.5% by weight), so as to avoid the generation of detrimental long nitrides that may occur crack generation. In particular embodiments, the nitriding process may be selected to avoid the presence of white layer. For instance, the components may be ground before nitriding process so as to avoid the formation of a white layer thereon.

Referring to FIG. 1, a treated Ferrium steel component 10 is shown formed from a core 12 of carburized Ferrium steel. The outer surface 13 is exposed to the nitrogen-containing plasma field 16 such that nitrogen diffuses into the surface 13 to form a surface portion 14 within the component 10 (e.g., greater than 0% to about 0.5% by weight of nitrogen in the surface portion 14). For example, nitrogen may be measurable in the surface portion 14 of the component 10 from the outer surface 13 to a depth of about 35 μm (e.g., about 0.1 μm to about 30 μm).

The nitriding process may be a nitriding plasma process performed in a nitrogen-containing atmosphere at a reaction temperature. In particular embodiments, the reactivity of the nitrogen-containing atmosphere is due to the gas ionized state, which is formed due to a combination of the heat treatment temperature and an electric field applied at the surface to be nitride. For example, the electric field may be used to generate ionized molecules of the gas (i.e., a "plasma") around the surface to be nitrided.

In one embodiment, electricity is applied to the surface 13 of the component 10 so as to create the electric field. In such an embodiment, the voltage of electricity applied to the surface 13 of the component 10 may be about 450 volts to about 550 volts.

Since nitrogen ions are made available by ionization, differently from gas or salt bath, plasma nitriding efficiency does not depend on the temperature. Plasma nitriding may be performed in a broad temperature range, such as about 260° C. to about 600° C. However, in certain embodiments, moderate temperatures may be utilized nitriding Ferrium steels without the formation of chromium nitride precipitates. In one embodiment, the nitriding process may a plasma nitriding process involving heat treatment temperatures of about 350° C. to about 500° C. (e.g., about 400° C. to about 475° C., such as about 425° C. to about 460° C.) in a nitrogen-containing atmosphere.

In the plasma nitriding processes, a nitrogen-containing gas (e.g., nitrogen gas, etc.) may be utilized as the nitrogen source, which may form the plasma atmosphere with or without any additional gas present. Other gasses, such as hydrogen or inert gases (e.g., argon) may also be present, such as a carrier gas. For example, the nitrogen-containing gas may be about 1% to about 50% by volume of the plasma atmosphere (e.g., about 5% to about 25% by volume, such as about 5% to about 15% by volume). In one embodiment, argon and/or hydrogen gas may be used before the nitriding process during the heating of the parts to clean the surfaces to be nitrided (e.g., to remove any oxide layer from surfaces). For example, the presence of hydrogen gas in the treatment atmosphere may allow for continued removal of any oxides on the surface of the component. Other cleaning processes may be performed also, such as through the use of solvents, etching, etc.

Figure 2:
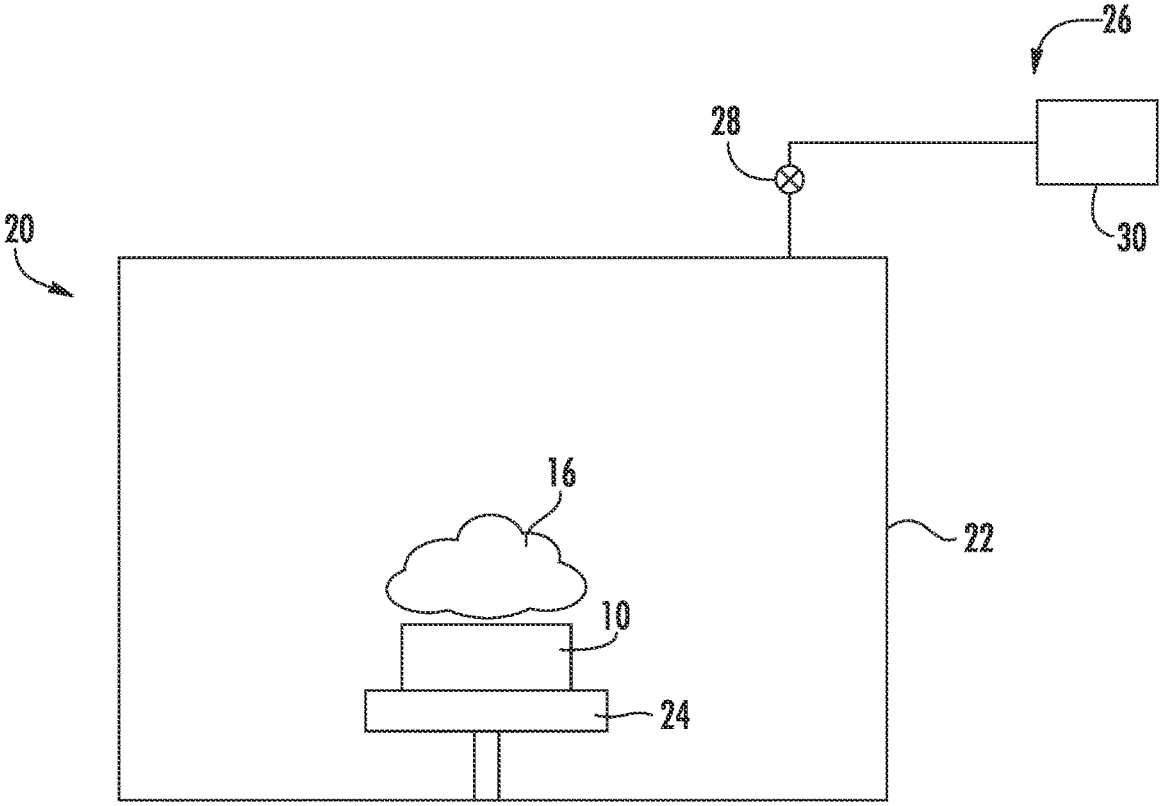
FIG. 2 shows an exemplary Ferrium steel component placed in a furnace for plasma nitriding on its surface.

As shown in FIG. 2, the component 10 may be placed in a furnace 20 having heated walls 22 (e.g., a hot wall furnace). The component 10 may be positioned, for example, on a platform 24 such that the plasma 16 is formed over the component 10. The total pressure within the furnace 20 may be controlled by the flow system 26, which may include a valve 28 controlling the flow rate of the gas system from the tank 30 into the furnace 20. In certain embodiments, the total pressure of the treatment atmosphere within the furnace 20 is about 0.5 millibar (mbar) to about 10 mbar (e.g., about 1 mbar to about 5 mbar).

In certain embodiments, the treated component may be ready for use following plasma nitriding, without any additional machining, polishing, or any other post-nitriding operations. However, in other embodiments, the carburized and nitride Ferrium alloy may be used after grinding or otherwise machining the component.

IV. Ferrium Steels

In particular embodiments, the Ferrium steels may have a composition after carburizing, but prior to nitriding, that includes, by weight, about 0.10% to about 0.2% of carbon (C), about 7.0% to about 10.0% of nickel (Ni), about 16.0% to about 18.5% of cobalt (Co), about 1.0% to about 2.0% of molybdenum (Mo), about 3.0% to about 4.0% of chromium (Cr), up to about 0.05% of tungsten (W), and the balance iron (Fe). For example, Ferrium steels may have a composition after carburizing, but prior to nitriding, that includes by weight percent about 0.10% to about 0.15% of C and/or about 7.5% to about 9.5% of nickel (Ni).

Exemplary Ferrium steels may include Ferrium C61 and C64. Ferrium C61 and C64 are highly hardenable secondary hardening martensic steel that, after carburizing treatment but prior to nitriding, reaches very high core hardness and mechanical properties. For example, Ferrium C61 may have a surface hardness on the Rockwell scale ($R_c$) of about 60 to about 62, and Ferrium C64 may have a surface hardness of $R_c$ about 62 to about 64 (values given represent hardness after carburizing treatment but prior to nitriding). Without wishing to be bound by any particular theory, it is believed that these alloys attain their properties due to nano-sized $M_2C$ carbide dispersions in a Ni—Co lath martensitic matrix.

The chemical compositions, after carburizing but prior to nitriding, of Ferrium C61 and Ferrium C64 are given below in Table 1 (in weight percent, wt. %):

TABLE 1

Exemplary Ferrium Steel Compositions

| Steel | C | Ni | Co | Mo | Cr | W | Fe |
|---|---|---|---|---|---|---|---|
| Ferrium C61 | 0.15 | 9.5 | 18.0 | 1.1 | 3.5 | 0 | Balance |
| Ferrium C64 | 0.11 | 7.5 | 16.3 | 1.75 | 3.5 | 0.02 | Balance |

Ferrium C61 and Ferrium C64 after duplex hardening treatment (e.g., including carburizing and nitriding) can offer improved performance for integrated components (e.g., integral race planet gears) in gearbox applications via exploitation of the advantage of both treatments: high core hardness and effective case depth through carburizing and very high surface hardness through nitriding.

For example, in certain embodiments, the surface hardness of Ferrium C61 may be increased to have a surface hardness on the Rockwell scale ($R_c$) of about 65 to about 67 (e.g., about 850 HV to about 900 HV using the Vickers Pyramid Number (HV)) following treatment via carburizing and plasma nitriding, such as described above. Similarly, the surface hardness of Ferrium C64 may be increased to have a surface hardness on the Rockwell scale ($R_c$) of about 65 to about 69 (e.g., about 66 to about 68) following treatment via carburizing and plasma nitriding, such as described above.

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A treated steel component, comprising:

a core of a carburized steel component having a composition that includes, by weight, 0.10% to 0.2% of carbon, 7.0% to 10.0% of nickel, 16.0% to 18.5% of cobalt, 1.0% to 2.0% of molybdenum, 3.0% to 4.0% of chromium, up to 0.05% of tungsten, and the balance iron; and a surface portion of the component having a composition that includes, by weight, 0.10% to 0.2% of carbon, 7.0% to 10.0% of nickel, 16.0% to 18.5% of cobalt, 1.0% to 2.0% of molybdenum, 3.0% to 4.0% of chromium, up to 0.05% of tungsten, 0.05% to 5% of nitrogen, and the balance iron.

2. The treated steel component of claim 1, wherein the surface portion defines an outer surface having a surface hardness on the Rockwell scale of 65 to 69.

3. The treated steel component of claim 1, wherein the surface portion has a depth from an outer surface of the component that is up to 35 μm.

4. The treated steel component of claim 1, wherein the core comprises carburized steel component having a composition that consists essentially of, by weight, 0.15% carbon, 9.5% nickel, 18.0% cobalt, 1.1% molybdenum, 3.5% chromium, and the balance iron, and wherein the carburized steel component has a surface hardness on the Rockwell scale of 65 to 67.

5. The treated steel component of claim 1, wherein the core comprises carburized steel component having a composition that consists essentially of, by weight, 0.11% carbon, 7.5% nickel, 16.3% cobalt, 1.75% molybdenum, 3.5% chromium, 0.02% tungsten, and the balance iron, and wherein the carburized steel component has a surface hardness on the Rockwell scale of 65 to 69.

6. The treated steel component of claim 1, wherein the steel component is carburized via a low pressure carburization (LPC) process.

7. The treated steel component of claim 6, wherein the steel component is nitrided, such that the carburized steel component has a surface portion with a nitrogen content that is 0.05% to 0.5% by weight.

8. The treated steel component of claim 7, wherein the steel component is a plasma nitrided component in a treatment atmosphere comprising a nitrogen-containing gas.

9. The treated steel component of claim 7, wherein the steel component is a plasma nitrided component in a treatment atmosphere comprising a nitrogen-containing gas and a carrier gas, wherein the treatment atmosphere comprises 1% to 50% by volume of the nitrogen-containing gas.

10. The treated steel component of claim 7, wherein the steel component is a plasma nitrided component in a treatment atmosphere comprising a nitrogen-containing gas and a carrier gas, wherein the treatment atmosphere comprises 5% to 25% by volume of the nitrogen-containing gas, and wherein the carrier gas comprises argon, hydrogen gas, or a mixture thereof.

11. The treated steel component of claim 6, where in the steel component is tempered at a tempering temperature of 400° C. to 550° C.

12. The treated steel component of claim 11, wherein the steel component is double tempered.

* * * * *